United States Patent [19]

Arnold

[11] 4,401,306

[45] Aug. 30, 1983

[54] FLOATING ROOF TANK SEAL

[76] Inventor: James F. Arnold, 6440 Hillcroft, Houston, Tex. 77081

[21] Appl. No.: 13,723

[22] Filed: Feb. 14, 1979

Related U.S. Application Data

[63] Continuation of Ser. No. 786,348, Apr. 11, 1977, abandoned.

[51] Int. Cl.[3] ..... B65D 87/18

[52] U.S. Cl. ..... 277/34.3; 220/222; 220/225

[58] Field of Search ..... 277/34, 34.3, 34.6; 220/221, 222, 224, 225

[56] References Cited

U.S. PATENT DOCUMENTS

| | | | |
|---|---|---|---|
| 2,366,711 | 1/1945 | Laird | 220/225 |
| 2,807,955 | 10/1957 | Loomis | 277/34.6 |
| 3,262,707 | 7/1966 | Williams | 277/34.3 |
| 3,787,061 | 1/1974 | Yoakum | 277/207 A |
| 4,029,425 | 6/1977 | Pelsue | 277/34.3 |

*Primary Examiner*—Robert I. Smith

[57] ABSTRACT

A seal arrangement is provided in a floating roof type tank for slidably sealing between the roof and the tank walls. The seal comprises an expansible tube carrying a lip with the latter extending angularly with respect to the tank walls so that upon inflation of the tube, the lip is moved outwardly and its engagement with the tank walls causes it to be resiliently bent inwardly from its normal unstressed position so that the resiliency of the lip maintains it in contact with the tank walls.

4 Claims, 3 Drawing Figures

FLOATING ROOF TANK SEAL

This is a continuation of application Ser. No. 786,348 filed Apr. 11, 1977 and now abandoned.

BACKGROUND AND SUMMARY OF THE INVENTION

For many years, liquids have been stored in cylindrical tanks having roofs buoyantly supported by the liquid. One problem which exists in many such storage tanks is to provide a sliding seal between the roof and tank walls so as to prevent escape of vapors from the tank. The problem becomes particularly acute when the liquid stored in the tank is petroleum or is one of a variety of petrochemicals.

Many arrangements have been suggested to provide a seal between the floating roof and the walls of the tank. These arrangements normally take the form of an elongated, hollow, inflatable tube disposed along the edge of the floating roof. The seal is formed by pressurizing the tube to cause it to fill in the space between the roof and walls of the tank. One problem arises from this seal when sufficient pressure is supplied to the tube to cause it to accommodate variations in wall shape, e.g. "ovaled tanks". This high pressure results in excessive friction between the tube and the normal tank walls thereby affecting the buoyancy of the roof. Another problem is caused by punctures occurring in the tubes. These punctures occur because of the direct contact between the tubes and the wall; such as, from sharp edges existing in the wall and from wear developing as the roof moves relative to the wall.

Accordingly, it is the primary object of this invention to provide a seal for a floating roof tank that will accommodate considerable variation in tank configuration without resulting in excessive friction.

Another object of the invention is to provide a seal for a floating roof tank which compensates for seal wear without a change in the fluid pressure.

Another object is to provide an inflated tube type seal which is not susceptible to damage or puncturing by sharp edges or the like on the tank wall.

In accordance with the invention, apparatus is provided for a seal in a floating roof tank. The seal uses at least one expandable tube having an extended lip with sufficient length and thickness to provide a resilient reaction when deflected in a direction toward the expanded tube. At least one clamp is attached to the roof and partially encloses the tube for restricting movement of the expanded tube away from the wall. A sufficient fluid pressure is supplied in each tube to expand the tube and cause the lip to deflect when contacting the wall in a generally spiralling direction around the tube which prevents substantial vapor losses from any liquid stored within the tank.

BRIEF DESCRIPTION OF THE DRAWINGS

Other objects and advantages of the invention will become apparent upon reading the following detailed description and upon reference to the drawings, in which.

Figure 1:
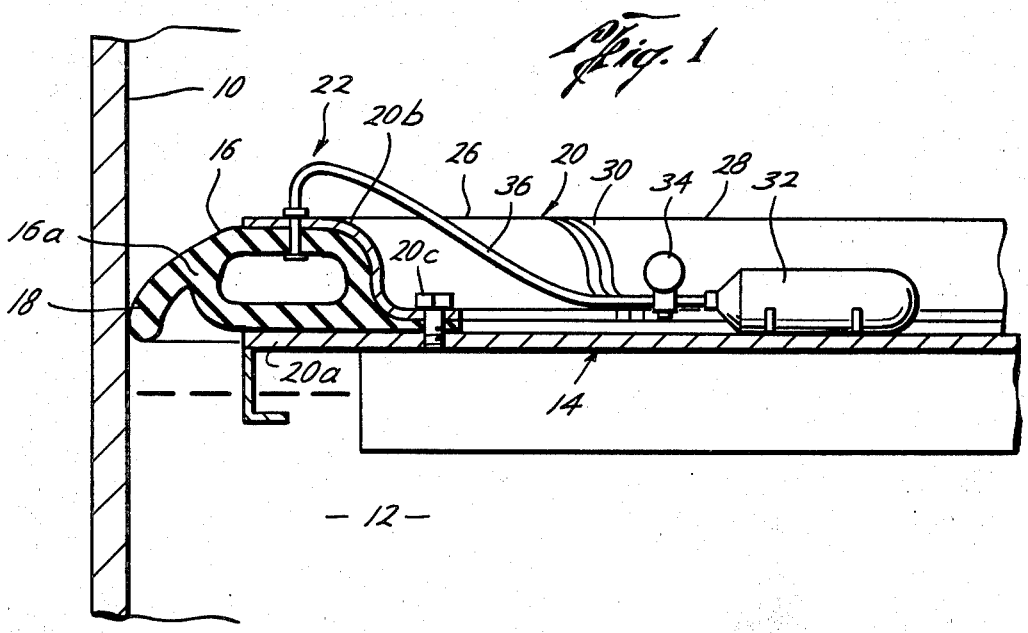
FIG. 1 is an elevational view, partly in section, of a first embodiment constructed according to the invention.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The drawings illustrate a section of a storage tank having a wall 10 which encloses a body of liquid 12 on which is floating a conventional floating roof 14.

In accordance with this invention, a seat arrangement is provided which affords a sliding seal between the floating roof 14 and the wall 10 of the tank. Thus, a resilient seal adapted to be arranged about the periphery of the floating roof includes two portions, an expansible tube portion 16 and a lip portion 18, the latter generally extending angularly from one side of the tube portion to form an acute angle with the vertical.

Arcuate clamp means are provided to extend along the periphery of the roof to enclose the sides of the tubular portion 16 other than that which carries the lip 18.

Means are also provided, indicated generally at 22, for supplying an inflating fluid to the tube portion 16 to cause it to expand and move side **16*a* and lip 18 outwardly toward the wall 10** of the tank to thereby move the lip into sealing engagement with such wall. As can be seen, the arrangement is such that when the lip is moved outwardly, it will be bent inwardly from its normal unstressed condition so that the resiliency of the lip maintains it in contact with the tank wall despite variation in the configuration of the latter.

As best illustrated in FIG. 1, the sealing arrangement for the roof preferably comprises a series of segments. Thus the periphery of the roof can be divided into discrete lengths and a segment provided for each length. In FIG. 1 two segments are shown generally at 26 and 28 and these are abutted with each other at 30. In some cases, it may be preferred to form the resilient seal segments in an arcuate shape but ordinarily these segments can be straight and then, when installed, curved to fit the periphery of the roof. Similarly, clamp means 20 is preferably provided in segments. As illustrated in FIG. 1, the clamp means comprises a portion **20*a* which is integral with the roof 14 and another portion 20*b* which is removably held on the roof by a cap screw 20*c*. This type of design is particularly favorable because normally the clamp portion 20*a* would exist on a roof and in order to convert the roof, it is merely necessary to tap and drill holes for studs 20*c*** then to clamp the resilient seal in place.

As indicated, means are provided for inflating tube portion 16. As illustrated, such means can comprise a bottle 32 of compressed gas, such as nitrogen. Such nitrogen flows through pressure regulator 34 and tube 36 to the interior of the tube portion 16. When a plurality of tubular segments are used to provide the peripheral seal, it is preferred that they all be maintained under the same pressure. To accommodate this, a plurality of tubes 36 from the common pressure regulator 34 can be used with one passing to each segment.

Figure 2:
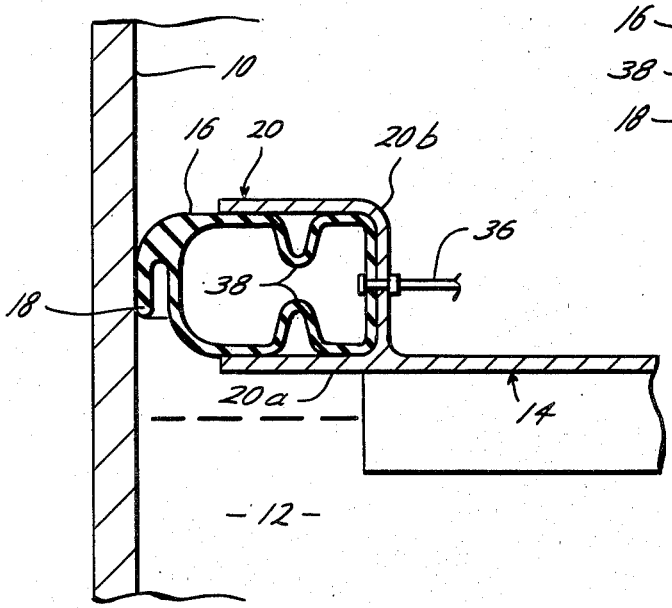
FIG. 2 is an elevational view, partly in section, of a second embodiment constructed according to the invention.

Referring to FIG. 2, tube portion 16 is provided with folds 38 formed on diametrically opposed sides. This facilitates expansion of the tube portion 16 to move lip portion 18 and to contact with the tank wall 10. FIG. 2 shows a clamp which is integral in its entirety with the roof.

Figure 3:
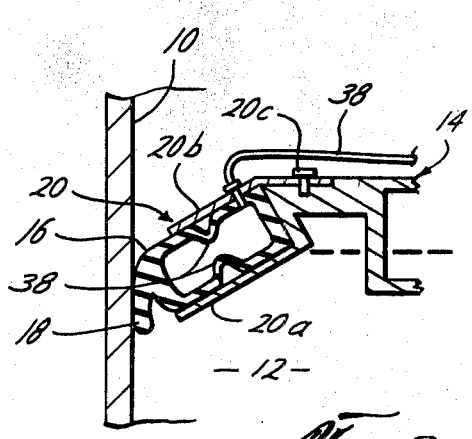
FIG. 3 is an elevational view, partly in section, of a third embodiment constructed according to the invention.

FIG. 3 shows an arrangement wherein the tube portion 16 is contained within a clamp 20 which is angulated with respect to roof 14 so that the lip 18 actually is emerged within the body of liquid 12. This may have the advantage of the liquid being able to provide some film lubrication for the lip.

What is claimed is:

1. A seal arrangement which, when installed, provides a sliding seal between a floating roof and the inner wall of a floating roof type tank, comprising:

a resilient seal adapted to be arranged about the periphery of the floating roof, said seal having an expansible tube portion and a lip portion, the latter having a base part attached to the tube portion and a sealing part extending from the base part outwardly and downwardly therefrom with the sealing part being spaced from the tube portion so as to be flexed about the base part toward and away from the tube portion responsive to the floating roof moving toward and away from the inner wall with the sealing part remaining in sliding sealing engagement with the inner wall;

arcuate clamp means adapted to be attached to the roof to extend along the periphery thereof to enclose the other three sides of the tube portion;

means for supplying an inflating fluid to said tube portion to cause it, when installed inside said clamp on the roof, to expand said tube and cause said one side to move outwardly toward the wall of the tank to thereby move the sealing part of the lip portion into sealing engagement with such wall, the arrangement being such that when the sealing part is so moved, it is bent inwardly from its normal unstressed position so that the resiliency of the lip maintains it in contact with the tank wall.

2. The arrangement of claim 1 wherein the resilient seal comprises a plurality of segments adapted to be abutted together endwise to extend around the tank roof.

3. The arrangement of claim 2 wherein the clamp means also comprise a plurality of arcuate segments.

4. The arrangement of claim 3 wherein a portion of the clamp means is integral with the tank roof and the remaining portion is removeable.

* * * * *